US005889477A

United States Patent [19]

Fastenrath

[11] Patent Number: 5,889,477

[45] Date of Patent: Mar. 30, 1999

[54] PROCESS AND SYSTEM FOR ASCERTAINING TRAFFIC CONDITIONS USING STATIONARY DATA COLLECTION DEVICES

[75] Inventor: Ulrich Fastenrath, Düsseldorf, Germany

[73] Assignee: Mannesmann Aktiengesellschaft, Düsseldorf, Germany

[21] Appl. No.: 823,610

[22] Filed: Mar. 25, 1997

[30] Foreign Application Priority Data

Mar. 25, 1996 [DE] Germany ..... 196 13 015.8

[51] Int. Cl.[6] ..... G08B 1/09

[52] U.S. Cl. ..... 340/905; 340/933; 340/934; 340/936; 340/286.14; 340/825.06; 701/117; 701/118; 701/119

[58] Field of Search ..... 340/933, 905, 340/934, 936, 286.14, 825.06; 364/423.098, 424.027, 424.029, 424.031, 436, 437, 438, 443; 701/117, 118, 119

[56] References Cited

U.S. PATENT DOCUMENTS

| | | | |
|---|---|---|---|
| 4,985,705 | 1/1991 | Stammler | 342/69 |
| 5,173,691 | 12/1992 | Summer | 340/905 |
| 5,293,163 | 3/1994 | Kakihara et al. | 340/905 |
| 5,317,311 | 5/1994 | Martell et al. | 340/905 |
| 5,406,490 | 4/1995 | Braegas | 340/905 |
| 5,539,645 | 7/1996 | Mandhyan et al. | 701/119 |

*Primary Examiner*—Jeffery A. Hopsass
*Assistant Examiner*—Julie B. Lieu
*Attorney, Agent, or Firm*—Cohen, Pontani, Lieberman & Pavane

[57] ABSTRACT

A process and apparatus for determining traffic conditions using stationary data collection devices that are installed in a road network. The data collection devices collect data about traffic conditions at the respective installation sites in keeping with an established measurement and then forward the collected information to a traffic center in keeping with an established reporting procedure where the data is analyzed to determine the traffic condition. At least a portion of the results of the analyses of the traffic center is transmitted to particular data collection devices. The measurement and reporting procedures of the particular data collection devices are modified or influenced based on the results of the analyses of the traffic center and as a result the data transmissions between the traffic center and data collections devices are substantially reduced.

10 Claims, 2 Drawing Sheets

PROCESS AND SYSTEM FOR ASCERTAINING TRAFFIC CONDITIONS USING STATIONARY DATA COLLECTION DEVICES

BACKGROUND OF THE INVENTION

1. Field of the Invention

The present invention relates to a process for determining traffic conditions using stationary data collection devices, e.g., detectors, that are installed at installation sites along a road network. The data collection devices collect data concerning traffic conditions at the respective installation sites in keeping with an established measurement procedure and then, in keeping with an established reporting procedure, transmit information derived from this data to a traffic center for further analysis.

2. Background of Related Art

European patent publication 0 029 201 B1 discloses an interactive dynamic route guidance system in which specially equipped vehicles engage in two-way communication with a traffic computer. In this system, beacons equipped with an infrared transmitter/receiver device are installed at important junctions in the road network. Vehicles with a corresponding transmitter/receiver device receive from a traffic computer current information, as for example the shortest route, with respect to time, to a desired target or destination. The main sources of information for the traffic computer are "float-along" sampling vehicles, which move along with the flow of traffic. The sampling vehicles transmit information, as for example, the time between important junctions and the waiting or delay times at stoplights, to the traffic computer. The traffic computer, based on this information, provides route guidance and traffic direction, for example, traffic guidance information may be transmitted to a vehicle and output via a control device on a display in the vehicle.

Another system for determining traffic conditions with detectors installed in a stationary manner is disclosed in U.S. Pat. No. 5,317,311. The detectors and associated sensor system, which is located, for example, on overpasses above the lanes of a highway, measure the average speed of passing vehicles and determine the number of vehicles that pass in a given unit of time. This data is transmitted through a data transmission channel such as a telephone line to a traffic center. In this system, the average speeds reported by the detectors are transmitted by transmitting devices from the traffic center to vehicles equipped with receiving devices. The data is received by the vehicles and graphically displayed on a display as a map of the sites of particular detectors. Drivers use this information to detect and avoid current problem areas in the road network or system. The detectors measure the average speeds so as to continuously monitor the traffic.

In contrast to the method of ascertaining traffic conditions disclosed in European patent publication 0 029 201 in which the relevant traffic data is detected by sampling vehicles and forwarded to data collection stations, e.g., beacons, which, in turn, transmit all of the data to a traffic center; the system disclosed in U.S. Pat. No. 5,317,311 collects the data using stationary sensor systems installed in the detectors themselves and transmits or reports only a limited amount of the data collected or detected by the detectors to the traffic center. In particular, data is transmitted or reported to the traffic center only when the average speed of the passing vehicles detected by the detectors during a certain time period falls below a preestablished threshold value, as for example a threshold value of approximately 50 km/h. As a result, the burden and bandwidth of the communication channel for data transmission is substantially reduced. This reduction in data transmission, however, disadvantageously limits the use of the system to situations in which there is very heavy traffic, e.g., traffic jams or similar situations. Thus, this traffic detection system is not suitable for detecting conditions in which the traffic is moderate or the roads are completely empty because of the limited reporting or transmission of collected data. The detection of conditions in which there is moderate traffic or in which the roads are completely empty is only possible if all of the information or data is reported which would require a corresponding increase in communications expenditure between the detectors and the traffic center.

The object of the present invention is therefore to provide a process for determining traffic conditions which establishes relatively inexpensive communications between the stationary detectors and the traffic center and is not limited in the information being observed or for use in only particular types of traffic conditions.

SUMMARY OF THE INVENTION

The present invention is directed to a process for determining traffic conditions using data collection devices, e.g., detectors, installed in a stationary manner at installation sites along a road network. The data collection devices collect data concerning the traffic conditions at the installation site of each respective data collection device in accordance with an established measurement procedure and, in accordance with an established reporting procedure, forward the information derived from this data to a center for ascertaining the traffic condition for further analysis. The analysis performed at the center comprises, for example, deriving a current traffic report and/or deriving historical traffic information and/or issuing traffic prognoses and/or identifying events that characterize the traffic conditions. The center then transmits to the data collection devices at least a portion of the results of the analysis. Thereafter, each particular data collection device, on the basis of these transmitted results, adjusts or modifies its measurement procedure and/or its reporting procedure in the manner of a learning system.

The results of the analysis of the center are selected in reference to the installation sites of individual data collection devices or a group of data collection devices. This selection may be performed at the traffic center or may be performed in the particular data collection device by filtering the transmitted results.

From time-to-time a currently valid graph curve for traffic-relevant measurement variables is derived in the traffic center and transmitted to a data collection device. The particular data collection device then reports to the center only detected deviations from the currently valid graph curve. The graph curve may be transmitted to the data collection device as a series of points of a function curve. Alternatively, a plurality of standardized graph curves may be stored in the data collection device whereby the center prescribes a graph curve for a data collection device by transmitting a code that is unambiguously associated with one of the stored graph curves. The graph curves may be based on classified weather conditions and/or traffic-relevant events.

Traffic conditions predicted for a particular installation site are transmitted to the data collection device in question. Assumptions about the current traffic conditions at an installation site are forwarded by the traffic center to the particular data collection device for checking, and detected deviations are reported back to the center by the data collection device. The center upon finding characteristics that indicate a problem upstream from the installation site of a data collection device or impending traffic congestion at the installation site (early indicators) sends these to the data collection device in question.

The present invention is also directed to a system for determining traffic conditions comprising a center with an electronic data processing unit for ascertaining the traffic condition and a communications unit. The system also includes a plurality of data collection devices installed at the side of a road network and a bidirectional communications channel for transmitting information from the data collection devices to the center. Each data collection device comprises a sensor system for collecting measurement values, an electronic data processing unit, a communications unit and an electric power supply unit. The electronic data processing device of each data collection device is programmed in such a way as to adjust, in the sense of a self-learning system, the measurement procedure and/or the reporting procedure of the data collection device on the basis of the results of the center in the framework of ascertaining the traffic condition.

Standardized graph curves for traffic-relevant measurement variables are stored in the data processing device of the data collection devices. Each graph curve is identifiable in the data collection device by a unique code sent from the center. The data processing device is programmed as a comparator to recognize substantial deviations of the current values of a measurement variable from a graph curve preestablished by the center. Alternatively, the system may be constructed so that each data collection device has a filter for the selection of results that are transmitted from the center and intended only for an individual data collection device or one group of data collection devices.

In the present invention, the traffic information to be transmitted or sent to drivers includes, in addition to detected average speeds, traffic information obtained by analyses of the detected data and other applicable information. In particular, these analyses include, for example, the derivation of current and/or historical traffic data and/or the issuing of traffic prognoses and/or the identification of events characteristic of traffic conditions. The traffic center transmits to the data collection devices at least a portion of the results of its analyses of the data received from the data collection devices. On the basis of the results of the analyses transmitted to the data collection devices from the traffic center, the measurement and/or reporting procedures or operations of a particular data collection device which collects data may be adjusted or set to establish new procedures in a type of learning process or operation. The data collection devices receive from the traffic center the same information transmitted by the center to drivers of vehicles using its services. This information is used to modify the procedures in order to optimize the data being collected and reported by the data collection devices. The measurement operation or procedure may be modified based on such factors and considerations, as for example, whether all measurement or detection of data should be suspended permanently, whether all measurement or detection of data should be temporarily suspended, what type of average values are to be detected or found and over what period of time. In addition, the reporting operation or procedure may be modified based on such factors, as for example, the dependence of data transmission on the existence of certain events and the preestablishment of certain time intervals between individual data transmissions. Optimization of data transmission is realized by providing the traffic center at all times with as much traffic data as is objectively required or needed, while keeping the expense for data transmission, and in particular, the burden on the communications channels, as small as possible.

The results of analyses by the traffic center are selectively transmitted to individual data collection devices or a group of data collection devices. This selection may be performed at the traffic center. In an alternate embodiment or modification, the selection of results may be performed in a particular data collection device by filtering means, as for example, is known and used in digital radio receivers (RDS/TMC=Radio Data System/Traffic Message Channel).

The traffic center from time-to-time produces a current graph curve of traffic-relevant measurement variables, for example, average speed, and transmits this curve to the particular data collection device to which the variable is applicable or appropriate. Thereafter, the data collection device transmits or reports to the traffic center only subsequently collected measurement variables or information which deviate at all, or alternatively deviate in excess of a predetermined acceptable range, from the current graph curve. As a result, the volume of information or data transmitted to the traffic center is reduced despite changes over time in the measurement variables collected. This reduction in data transmitted to the traffic center is based on the underlying principle that the transmission of data from a data collection device to the traffic center is completely superfluous or redundant so long as the "model" that the center has of the current traffic condition at that particular measurement point does not differ substantially from reality, that is from the values or data being detected This comparison may be made by the particular data collection device itself when the "model" of the center, i.e., the graph curve for a given measurement variable, is stored in a memory device in the data collection device or is transmitted to the data collection device as a series of points of a function curve. In an alternate embodiment, standardized graph curves of the traffic-relevant measurement variables for typical traffic conditions are stored in the data collection devices and a standardized graph curve is selected in response to unique codes associated with the stored graph curves which are transmitted by the traffic center. The various graph curves are based on such factors as weather conditions (e.g., dry weather, rain, ice/snow), and/or traffic-relevant events (e.g., road construction) and/or large public events (e.g., trade fairs, football games, etc.).

In addition, the traffic prognosis for a particular installation site is transmitted to the corresponding data collection device in order to optimize the measurement and/or reporting behavior of the data collection device. This operation is similar to the process variant in which graph curves are preestablished for the data collection devices, because both operations are based on future expectations of the traffic center. The process according to the invention also transmits assumptions about current traffic conditions at an installation site from the traffic center to a particular data collection device for checking or confirmation of the traffic condition. In the event that actual traffic conditions substantially deviate from the assumptions the data collection device will transmit an appropriate message to the traffic center.

Processes for determining traffic conditions are known in which the data collection devices use a reporting procedure which depends on locally recognizable traffic conditions. In other words, single or periodic reports to the traffic center are triggered when the local conditions exceed or fall below certain threshold values. These methods, however, are relatively insensitive to special local features (e.g., sections of road with hills or curves), to measurement values that indicate user-relevant phenomena at some distance from the data collection device (e.g., traffic problems upstream from the measurement point, to temporary external influences (e.g., weather conditions) or to distinguishing features of traffic conditions that have different causes but similar symptoms (e.g., traffic congestion at construction bottlenecks and "shifting overload congestion"). However, the aforementioned features and factors are reflected in characteristic movements or jumps of the working point in the fundamental diagram, which shows the interrelations of speed, traffic flow (e.g., vehicles per hour), and traffic density (e.g., vehicles per unit of road length). The data collection devices of the present invention, after completing a learning phase, identify traffic variables or information which are relevant and measure or detect and report or transmit to the traffic center only relevant-traffic information. Initially during the learning phase, the entire scope of the collected measurement data is transmitted to and analyzed at the traffic center. The analysis may be performed using, for example, conventional statistical methods, methods based on the training of neural networks or "fuzzy" algorithms. The results of the analyzes are transmitted to the data collection devices which recognize or identify traffic features or data which is to be reported to the traffic center. During this learning process, which is determined based on analyses over a relatively long period of time, the data collection devices simultaneously receive historical traffic information which is used to recognize the initial indicators of user-relevant events. The user-relevant events are, in turn, forwarded to the traffic center and are used to assess the traffic condition.

The current traffic information is also used to reduce the transmission of redundant measurement data. Information may be provided to a data collection device by sources in the process or, alternatively, may also originate from sources outside of the present inventive process which is checked or confirmed by the appropriate data collection device. The information provided to a data collection device includes not only reports about traffic problems that exist or have been cleared up, but also includes predictions made by the traffic center that take into account external factors known in advance, such as weather conditions or construction plans, and may be used by a specific data collection device to recognize deviations to be reported to the traffic center. In this context, user-relevant deviations include unexpected problems that occur and expected problems that do not occur. The traffic information sent to a data collection device for checking or confirmation is not necessarily limited to centrally collected data on current conditions and may include predictions for a short or brief time period relative to a daily graph curve. The traffic center detects or identifies early indicators, that is characteristics that indicate a problem upstream from the installation site of a data collection device or point to impending congestion at its installation site, and transmits this information to the appropriate data collection device.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
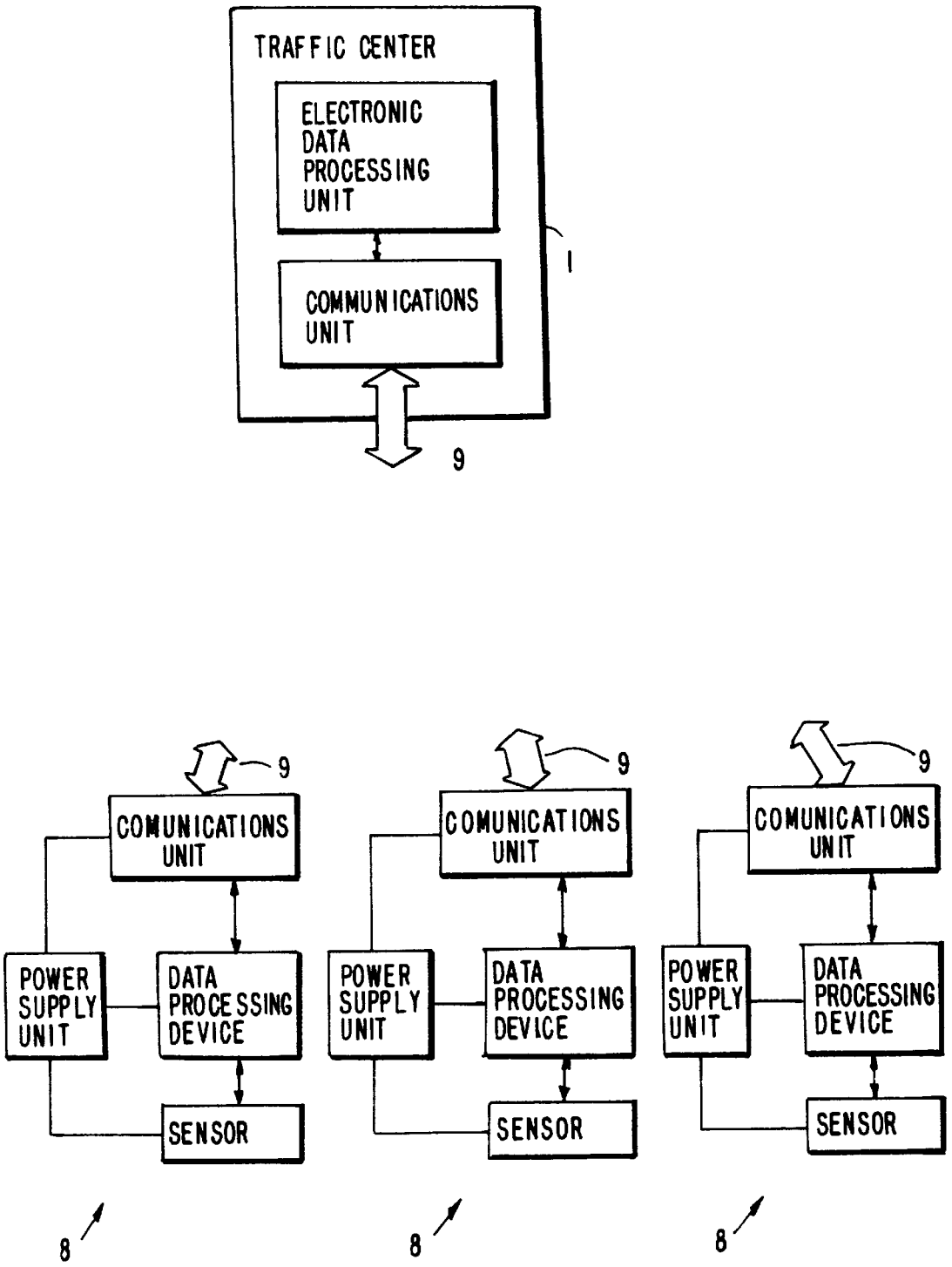
FIG. 1 depicts the system for determining traffic conditions using stationary data collection devices of the present invention.

An illustrative example of a system for detecting a traffic condition according to the present invention is shown in FIG. 1, including a traffic center 1 and three data collection devices 8. It should be noted that although three data collection devices 8 are illustrated and described it is within the intended scope of the invention to construct the system with one or more data collection devices. The traffic center 1 comprises an electronic data processing unit 2 and a communications unit 3. Information and data is transmitted between the traffic center 1 and the data collection devices 8 over a bidirectional or two-way communications channel 9, as for example, telephone lines, but is preferably a wireless network such as a mobile phone wireless network. The data collection devices are installed at roadside, as for example, on overpasses above highways or roadways in a road network, and are designed to collect or measure relevant data which is transmitted or reported to the traffic center 1 where the data is analyzed to determine the traffic condition. Each data collection device 8 includes a communications unit 4, an electronic data processing device 5, a sensor system 6 for collecting measurement values and an electric power supply unit 7. In a preferred embodiment the power supply unit 7 is a battery-buffered solar cell unit. The sensor system 6 comprises conventional sensors such as active or passive infrared sensors or as microwave sensors and preferably includes sensors based on different measurement principles in a single data collection device 8. Relevant data collected at the data collection device is transmitted by the communications unit 4 to the traffic center 1 over the communications channel 9 in order to determine the traffic condition. In addition, at least some of the results of the data analyses from the traffic center is transmitted by the communication device 3 to the data collection devices 8 over the bidirectional communications channel 9. Based on results of the data analyses received from the traffic center 1, the data processing devices 5 of the data collection devices 8 adjust their measurement procedures and/or reporting procedures in a type of self-learning phase or operation and change their procedures as needed in order to optimize overall transmission efficiency.

In another embodiment of the invention, standardized graph curves for traffic-relevant measurement variables are stored in a memory or storage device (not shown separately) of the data processing unit 5 of the data collection device 8. Particular standardized graph curves are selected in response to unique codes associated therewith which are transmitted from the traffic center 1. As a result, the traffic center 1 selects or identifies a particular graph curve to a particular data collection device 8 based on the associated unique code without having to transmit a series of points or large number of individual values which characterize the graph curve in the particular case. The data processing device 5 is programmed as a comparator in order to recognize any deviations or deviations exceeding or greater than a predetermined acceptable threshold or range between currently collected values for a measurement variable and a graph curve preestablished by the traffic center 1. Thus, the reporting procedures of the respective data collection devices 8 may be optimized in that data is transmitted via the communications channel 9 to the traffic center 1 only when deviations are detected. When deviations are not detected, data transmissions from the data collection devices 8 to the traffic center 1 is stopped or prevented. In an alternative embodiment of the invention, each of the data collection devices 8 includes a filter for selecting events that are transmitted by the traffic center 1 and intended only for individual data collection devices 8 or a group of data collection devices 8. Thus, the operation or performance of an individual data collection device 8 or a group of data collection devices 8 installed along a certain stretch of roadway or highway, for example, may be deliberately influenced by the traffic center 1. The data collection devices 8 determine by comparing the detected traffic data with that of the traffic information distributed to drivers by the traffic center 1 whether the traffic condition determined by the traffic center 1 matches or agrees with the actual traffic condition at the installation sites. If the two sets of information do not match, then the transmission of data from the data collection device 8 to the traffic center 1 is initiated immediately to correct the error.

The scope of data transmissions required to determine the traffic condition in a road network is therefore substantially reduced using this present inventive process and apparatus. This reduction in data transmission is due in part to the data collection devices 8 which continuously receive and assess at least part of the analyses results of the traffic center distributed to the drivers concerning the ascertained traffic condition as well as targeted individual information.

Figure 2:
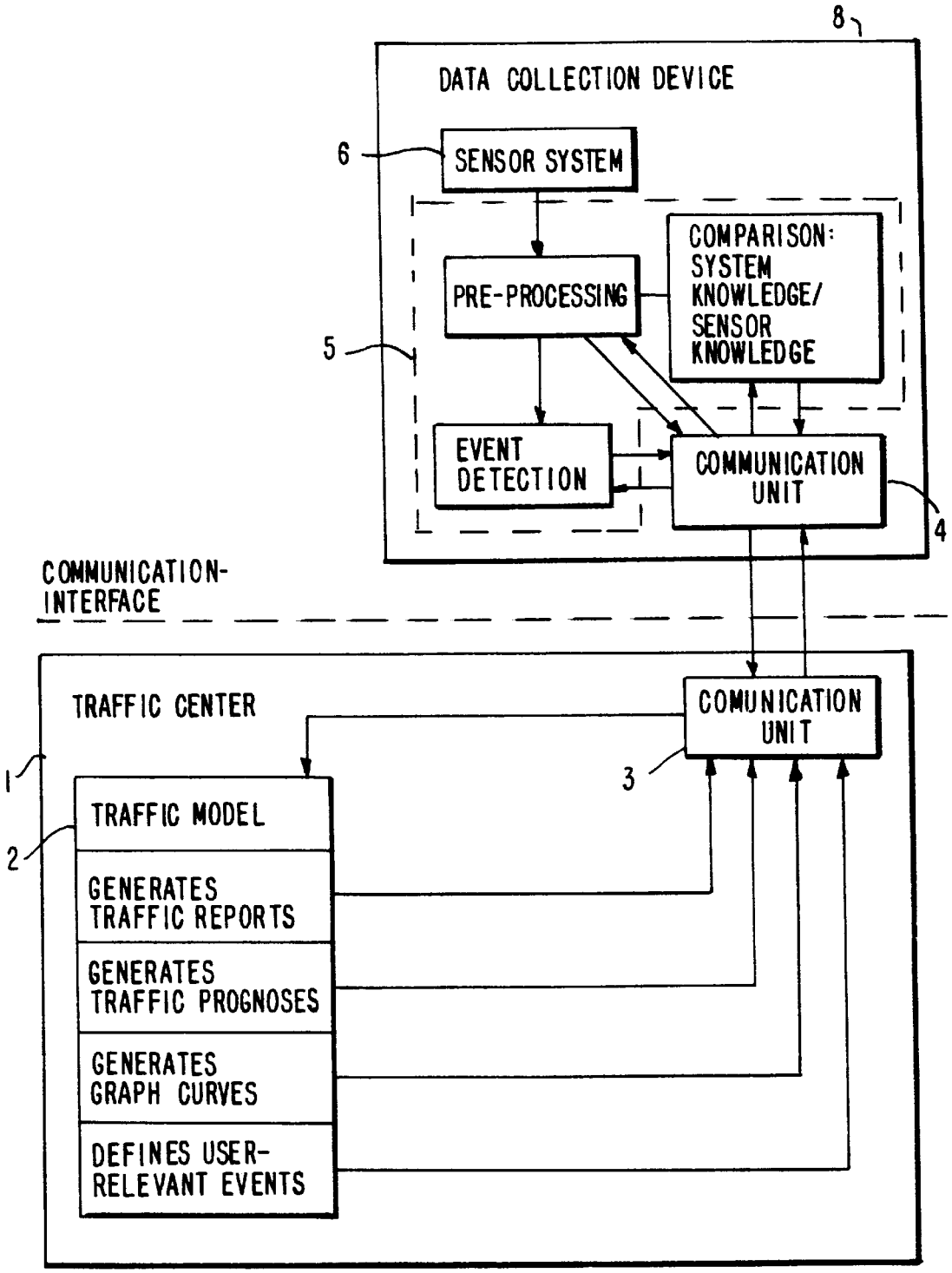
FIG. 2 diagrammatically depicts the basic functions of the traffic center and data collection device of the present invention.

FIG. 2 shows some of the functions and operations of the process according to the invention for the two main components, the traffic center 1 and the data collection device 8. Since the functions of each data collection device 8 is substantially the same only one data collection device 8 is illustrated and described in FIG. 2. The information or communication flow between components is symbolized by arrows. A suitable sensor system 6 measures traffic-relevant data, e.g., current speeds of passing vehicles, and the measured data is then preprocessed in the data processing device 5 of the data collection device 8. Preprocessing of the collected or measured data may, for example, comprise finding an arithmetic mean value over a certain observation period or compressing the collected data. The data collection devices may be programmed based on user-relevant events that have been defmed in advance by the traffic center 1. In addition, the data processing device 5 of the data collection device 8 may also be programmed to compare "sensor knowledge" (measurement values from a certain period up to the present) with "system knowledge" (current traffic reports, traffic predictions and historical information in the form of graph curves, for example) and then report deviations, for example, which are of immediate importance in assessing the current traffic condition or supplement and/or correct the "system knowledge." Information is communicated or transmitted between a communications unit 4 of the traffic center 1 and the communications unit 3 of the traffic center 1 via a two-way communications interface or bidirectional communications channel. The data processing device 2 in the traffic center 1 is labeled "traffic model". This data processing device receives the collected data from the data collection device 8 and analyses this information to determine or ascertain the traffic condition. As shown in FIG. 2, the results of the analyses of the data processing unit 2 of the traffic center 1 may include, for example, generated traffic reports, traffic prognoses, graph curves and/or identification of user-relevant events. These analyses results are then transmitted to the drivers of the vehicles to be used as guidance. Moreover, at least a portion of the results of the analyses of the traffic center 1 are also transmitted to particular data collection devices 8 over the communications channel 9 to modify or influence the measurement and/or reporting procedures of the data collection devices and thereby reduce the amount of transmitted data.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A process for determining traffic conditions using stationary data collection devices installed at installation sites in a road network, each data collection device collects data on traffic conditions at the respective installation site in accordance with a preestablished measurement procedure and reporting procedure, and thereafter information derived from the collected data is forwarded to a traffic center in which the traffic condition is determined, said process comprising the steps of:

analyzing the collected data using an electronic data processing device in the traffic center;

transmitting a portion of the results of the analyses of the traffic center to particular data collection devices by selecting at least one of individual data collection devices or a group of data collection devices as the particular data collection devices based on their respective installation sites, wherein said selecting step is performed by a filter in the particular data collection device; and adjusting at least one of the measurement and reporting procedures of the particular data collection devices using an electronic data processing device in the particular data collection device based on the results of the analyses of the traffic center.

2. The process in accordance with claim 1, further comprising the steps of:

generating a current graph curve of traffic-relevant measurement variables in the traffic center;

transmitting the current graph curve to the particular data collection devices; and comparing currently detected traffic conditions by the particular data collection device with the current graph curve using the data processing device in the particular data collection device; and reporting using the particular data collection device the currently detected traffic conditions when a substantial deviation is detected between the currently detected traffic conditions and the current graph curve.

3. The process in accordance with claim 2, wherein said step of transmitting the current graph curve is performed by transmitting a series of points of a function curve.

4. The process in accordance with claim 2, wherein said step of transmitting the current graph curve comprises the step of selecting one of a plurality of standardized graph curves stored in a memory device in the data collection device in response to a unique code, unambiguously associated with the one of the stored standardized graph curves, transmitted from the traffic center to the particular data collection device.

5. The process in accordance with claim 4, wherein the graph curves are a function of at least one of weather conditions and traffic-relevant events.

6. The process in accordance with claim 1, wherein said transmitting step comprises the step of transmitting predicted traffic conditions concerning a particular installation site to the respective data collection device.

7. The process in accordance with claim 1, further comprising the steps of:

transmitting assumptions concerning current traffic conditions for a particular installation site to the particular data collection device; and comparing, using the data processing device of the particular data collection device, the assumption of traffic conditions and traffic conditions detected by the particular data collection device; and reporting to the traffic center deviations detected by the particular data collection device between the assumption of traffic conditions and the traffic conditions detected by the particular data collection device.

8. The process in accordance with claim 6, further comprises the steps of:

identifying at the traffic center early indicators of a traffic condition occurring one of upstream from an installation site and at an installation site; and reporting the identified traffic condition to the respective data collection device.

9. The process in accordance with claim 1, wherein the results of the analyses of the traffic center comprises at least one of generated current traffic reports, generated historical traffic information, issued traffic prognoses and identified events which characterize traffic conditions.

10. A system for determining traffic conditions comprising:

a plurality of data collection devices installed along a roadway in a road network, each data collection device comprising:

a sensor system for detecting traffic-relevant values;

a first electronic data processing device connected to said sensor system;

a first communications device connected to said first electronic data processing device; and an electric power supply device supplying power to said sensor system, said first electronic data processing device and said first communications device;

means for analyzing the data collected by said sensor system, said analyzing means comprising:

a second electronic data processing device for determining the traffic condition;

a second communications device connected to said second electronic data processing device; and means for transmitting data bidirectionally between said analyzing means and said data collection devices;

said first electronic data processing device being programmed for adjusting at least one of measurement and reporting procedures of said data collection device as a function of the analyses results of said analyzing means;

wherein said first electronic data processing device further comprises a storage device for storing a plurality of standardized graph curves of traffic-relevant measurement variables each of the stored standardized graph curves having a corresponding unique code, and said first electronic data processing device is programmed to compare data currently collected by said sensor system with one of the stored plural standardized graph curves preestablished by said analyzing means by the unique code and wherein each data collection device further comprises a filter for filtering the results of the analyses of said analyzing means intended for the particular data collection device.

* * * * *